US005738021A

United States Patent [19]

Vatsky et al.

[11] Patent Number: 5,738,021

[45] Date of Patent: Apr. 14, 1998

[54] ADJUSTABLE SLEEVE DAMPER ASSEMBLY FOR A COAL-FIRED FURNACE

[75] Inventors: Joel Vatsky, West Orange; Walter Van Dyke, Wyckoff, both of N.J.

[73] Assignee: Foster Wheeler Energy International, Inc., Clinton, N.J.

[21] Appl. No.: 597,588

[22] Filed: Feb. 6, 1996

[51] Int. Cl.[6] ..... F23L 9/00; F23L 3/00

[52] U.S. Cl. ..... 110/163; 110/260; 110/261; 110/263; 110/265; 251/129.11

[58] Field of Search ..... 110/260, 261, 110/262, 263, 264, 265, 163; 431/188, 12, 187; 251/129.11, 266

[56] References Cited

U.S. PATENT DOCUMENTS

| | | | |
|---|---|---|---|
| 1,165,835 | 12/1915 | Birkholz | 431/188 |
| 1,938,458 | 7/1933 | McFarlane | 251/266 |
| 1,938,460 | 7/1933 | Muff | 251/266 |
| 1,995,934 | 3/1935 | Mangold . | |
| 2,056,410 | 10/1936 | Schaaf | 126/285 |
| 2,271,587 | 2/1942 | Haynes . | |
| 2,480,547 | 8/1949 | Caracristi . | |
| 2,485,656 | 10/1949 | Raskin | 431/188 |
| 2,838,103 | 6/1958 | Voorheis . | |
| 2,889,871 | 6/1959 | Voorheis . | |
| 3,391,981 | 7/1968 | Voorheis et al. . | |
| 3,580,238 | 5/1971 | Diehl | 126/295 |
| 4,400,151 | 8/1983 | Vatsky . | |

*Primary Examiner*—Ira S. Lazarus
*Assistant Examiner*—Nhat-Hang H. Lam
*Attorney, Agent, or Firm*—Haynes and Boone, L.L.P.

[57] ABSTRACT

An air damper assembly for a coal-fired furnace in which a damper sleeve extends between two spaced walls adjacent the furnace in a manner to define an air inlet. A threaded support member is connected to the damper, and a threaded shaft is in threaded engagement with the support member. Rotation of the shaft causes corresponding movement of the support member, and therefore the damper, to vary the size of the opening and therefore the amount of air introduced into the furnace.

9 Claims, 2 Drawing Sheets

ADJUSTABLE SLEEVE DAMPER ASSEMBLY FOR A COAL-FIRED FURNACE

BACKGROUND OF THE INVENTION

This invention generally relates to an adjustable sleeve damper assembly and, more particularly, to an adjustable sleeve damper assembly for controlling the flow of secondary air towards the outlet of a burner positioned adjacent an opening in a wall of a coal-fired furnace.

In coal-fired furnaces, a mixture of particulate coal and air is usually introduced to the inlet end portion of each of a plurality of burners respectively positioned adjacent corresponding openings in the furnace wall. The mixture passes through each burner and is discharged from the burner outlets and into their respective furnace openings in a specific pattern depending on the design of the burners and the furnace. A plenum chamber, or windbox, is usually provided in proximity to the burners which receives additional air, often termed "secondary air", and directs the latter air towards the outlets of the burners and their respective furnace wall openings. The secondary air performs a combustion-supporting function and improves the overall combustion performance.

Since each burner is located differently with respect to the furnace wall and receives slightly different quantifies of fuel depending on their specific location relative to the latter wall, the flow of secondary air to each burner must be carefully controlled to insure optimum combustion at each burner, particularly during start-up. An example of a system to control secondary air discloses a movable sleeve damper, which forms the outer boundary of the windbox. The sleeve damper is movable parallel to the longitudinal axis of the burner and across the air inlet to the windbox to regulate the quantity of air flow into the windbox. An elongated worm gear is provided for moving the sleeve damper and has one end portion suitably connected to an appropriate drive means for rotating the worm gear and the other end provided with threads. The latter threads mesh with appropriate apertures formed in the sleeve damper so that, upon rotation of the worm gear, the sleeve damper moves longitudinally with respect to the longitudinal axis of the burner and across the air inlet deigned by the plates. In this manner, the quantity of secondary air passing into and through the windbox and to the furnace opening can be controlled by axial displacement of the sleeve damper. Although this design proved to be eminently satisfactory, it was difficult to keep the above-mention worm gear free from dirt, debris, airborne coal particles, and the like, which rendered it susceptible to dogging and jamming.

SUMMARY OF THE INVENTION

The present invention is an improvement over the sleeve damper assembly disclosed in the above patent and, as such, enables the flow of the secondary air to be precisely controlled yet stay relatively clean and free from clogging, jamming and the like. To achieve this, the assembly of the present invention includes a sleeve damper which defines an air inlet between two spaced walls. A threaded shaft is supported between the two walls, and at least one internally threaded support member is connected to the damper and is in threaded engagement with the shaft. As a result, rotation of the shaft causes corresponding movement of the support member, and therefore the damper, to vary the size of the inlet opening. The support member is designed to allow any foreign matter between it and the drive shaft to escape, thus reducing clogging and jamming.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENTS

Figure 1:
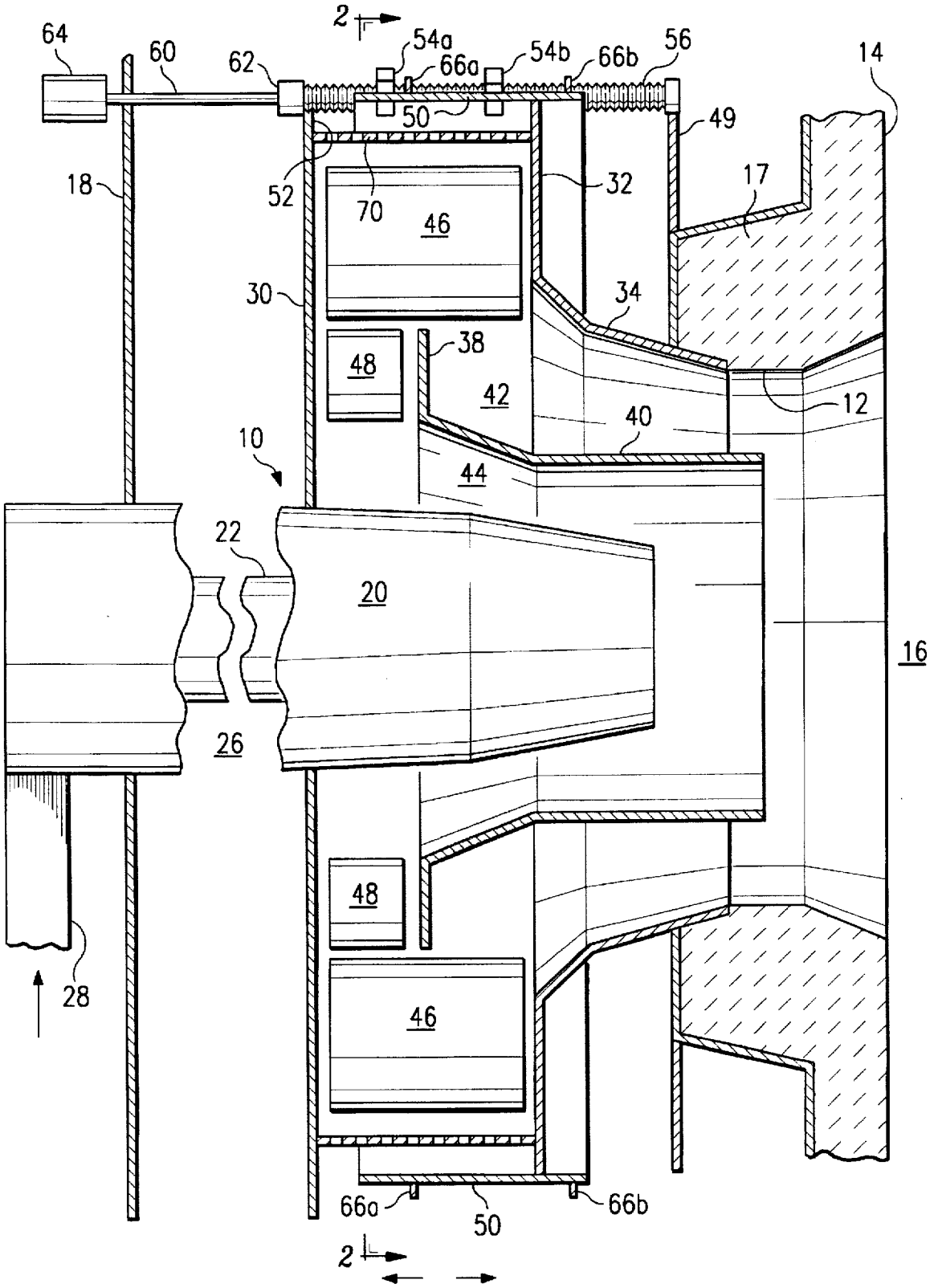
FIG. 1 is a sectional view depicting the burner assembly of the present invention.

Referring specifically to FIG. 1 of the drawings the reference numeral 10 refers in general to a burner assembly which is disposed in axial alignment with a through opening 12 formed in a front wall 14 of a conventional furnace. It is understood that the furnace includes a back wall and side walls of an appropriate configuration to define a combustion chamber 16 immediately adjacent the opening 12. Also, similar openings are provided in the furnace front wall 14 for accommodating additional burner assemblies identical to the burner assembly 10.

The inner surface of the wall 14, as well as the other walls (not shown) of the furnace are lined within an appropriate thermal insulation material 17 and, while not specifically shown, it is understood that the combustion chamber 16 can also be lined with vertically extending boiler tubes through which a heat exchange fluid, such as water, is circulated in a conventional manner for the purposes of producing steam.

A vertical wall 18 is disposed in a spaced, parallel relationship with the furnace wall 14 in a direction away from the combustion chamber 16. The wall 18 forms the inner wall of a windbox which receives combustion supporting air, commonly referred to as "secondary air," and distributes the air to the combustion chamber 16 in a manner to be described The burner assembly 10 includes a nozzle 20 having an inner tubular member 22 and an outer tubular member 24 extending over the inner tubular member 22 in a coaxial, spaced relationship to define an annular passage 26 which extends towards the furnace opening 12. A tangentially disposed inlet 28 communicates with the outer tubular member 24 for introducing a stream of fuel into the annular passage 26 for passage through, and discharge from, the burner assembly 10 in a manner to be described.

A pair of spaced annular plates 30 and 32 extend around the nozzle 20 and parallel to the wall 18, with the inner edge of the plate 30 terminating on the outer tubular member 24. A liner member 34 extends from the inner edge of the plate 32 and in a general longitudinal direction relative to the nozzle 20 and terminates adjacent the opening 12 in the furnace wall 14. An additional annular plate 38 extends around the nozzle 20 in a spaced, parallel relation with the plates 30 and 32. An air divider sleeve 40 extends from the inner surface of the plate 38 and between the liner 34 and the nozzle 20 to an area just inside the opening 12 to define two air flow passages 42 and 44.

A plurality of outer register vanes 46 are pivotally mounted between the plates 30 and 32 to control the swirl of secondary air from the wind box to the air flow passages 42 and 44. In a similar manner, a plurality of inner register vanes 48 are pivotally mounted between the plates 30 and 38 to further regulate the swirl of the secondary air passing through the annular passage 44. It is understood that although only two register vanes 46 and 48 are shown in FIG. 1, several more vanes extend in a circumferentially spaced relation to the vanes shown. Also, the pivotal mounting of the register vanes 46 and 48 may be done in any conventional manner, such as by mounting the vanes on shafts (shown schematically in FIG. 1) and journalling the shafts in proper bearings formed in the plates 30, 32 and 38. Also, the position of the vanes 46 and 48 may be adjustable by means of cranks or the like. Since these types of components are conventional they are not shown in the drawings nor will be described in any further detail.

An annular wall 49 extends radially outwardly from the liner 34 in a spaced parallel relationship with the outer windbox wall 18 to form the inner wall of the windbox. The radially outer boundary of the windbox is formed by a damper sleeve 50 which extends around the outer periperphies of the plates 30 and 32 and is slidably disposed on the outer periphery of the plate 32 for axial movement parallel to the longitudinal axis of the burner nozzle 20. The rear end of the sleeve 50 and the outer end of the wall 80 define an inlet opening 52 the size of which is varied by the slidable movement of the sleeve 50. To this end, and with reference to FIGS. 1 and 2, a longitudinal cut is made through the sleeve 50 and a pair of spaced, internally threaded, support members **54*a* and 54*b*** are welded, or otherwise attached, to the ends of the sleeve formed by the cuts.

The support members **54*a* and 54*b* threadedly engage an externally threaded shaft 56 one end of which is rotatably mounted in a bearing member 58 mounted on the outer edge of the plate 82. It is also noted from FIG. 2 that the lower portion of each support member 54*a* and 84*b*** is cut out to permit cleaning of the interior portion of each support member while still preventing upward movement of the support members relative to the shaft.

A drive shaft 60 (FIG. 1) is coupled to the threaded shaft 56 by a coupler/bearing assembly 62 supported at the outer edge portion of the plate 80, and a motor 64 is in driving engagement with the drive shaft 60 to apply a torque to the shaft 60. As a result, the threaded shaft 56 is also rotated to cause axial, or linear, movement of the support members **54*a* and 54*b* which, in turn causes axial movement of the sleeve 50. It is understood that the motor 64 can apply torque to the drive shaft in both a clockwise and counter-clockwise direction which causes corresponding axial movement of the sleeve 50 to and from the plate 30, as indicated by the arrows in FIG. 1, to respectively decrease and increase the size of the inlet opening 52. In this context, the width of the sleeve 50 substantially corresponds to the distance between the plates 30 and 32 so that the sleeve can completely block the opening if moved all the way to the left as viewed in FIG. 1**.

A pair of spaced ribs **66*a* and 66*b* extend from the outer surface of the sleeve 50 to add structural integrity to the sleeve. Also, an opening is formed through each of the ribs 66*a* and 66*b*, with one of the openings being referred to by the reference numeral 68 in FIG. 2. Although not shown in the drawings, it is understood that a guide shaft is secured between the two plates 30 and 49 and extends through the opening 68 in the rib 66*a* and through the aligned opening (not shown) extending through the rib 66*b* to further guide and support the sleeve 50. A perforated air hood 70 extends between the plates 30 and 32 immediately downstream of the sleeve 50 to permit independent measurement of the air flow to the nozzle 20**.

In operation, the motor 64 is activated to rotate the drive shaft 60, and therefore the threaded shaft 56, to cause corresponding linear movement of the support members **54*a* and 54*b*, and therefore the sleeve 50, towards or away from the plate 30 depending on the direction of rotation. This movement varies the size of the inlet opening 52 until a predetermined size is achieved depending on the combustion requirement of the nozzle 20**.

Secondary air enters the windbox through the opening 52 and passes by the register vanes 46 and 48 in the air flow passages 42 and 44. The vanes 46 and 48 impart a swirl to the air as it discharges into the furnace opening in a combustion-supporting relationship to the air and fuel exiting from the nozzle 20.

Thus, according to the present invention the secondary air flow to each burner, including the nozzle 20, associated with the furnace wall 14 can be precisely controlled and the pressure drop across the air hoods 70 associated with each burner can be equalized, permitting a substantially uniform air distribution across the furnace. This enables the unit to operate at lower excess air with significant reductions in both nitrogen oxides and carbon monoxides. Also, the provision of separate register vanes 46 and 48 for the outer and inner air flow passages 42 and 44 enables secondary air distribution as well as flame shape to be independently controlled resulting in a significant reduction of nitrogen oxides, and a more gradual mixing of the primary air coal stream with the secondary air since both streams enter the furnace on parallel paths with controlled mixing. Moreover, all the above is accomplished while minimizing jamming or clogging of the drive system for the damper sleeve 50, since any dirt, debris, coal particles, and the like, that accumulate on the drive shaft 50 and enter the support members **54*a* and 54*b*** will fall through the lower open portions of the latter members.

Figure 2:
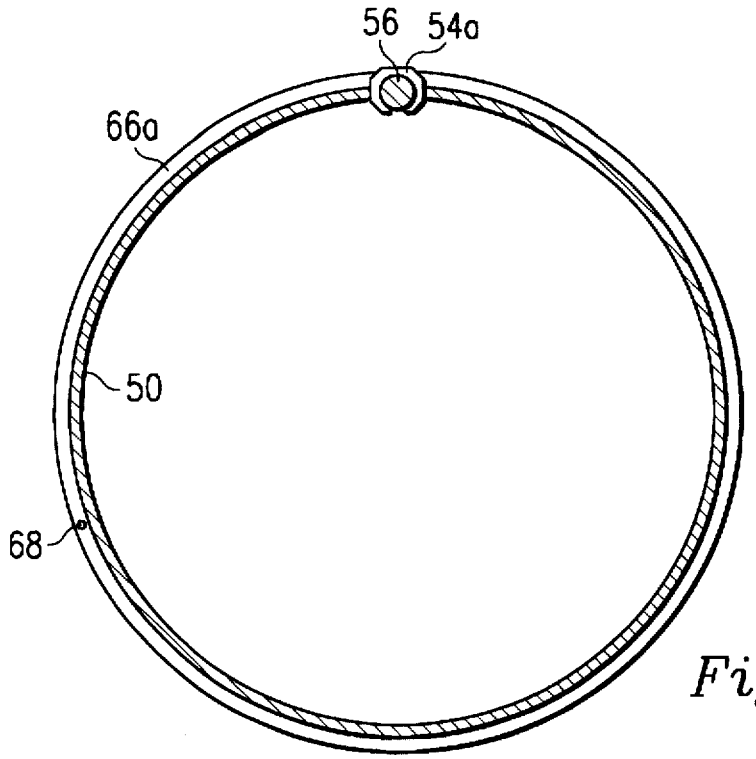
FIG. 2 is a reduced sectional view taken along the line 2—2 of FIG. 1 with all structure extending within the register sleeve not being shown in the interest of clarity.
Figure 3:
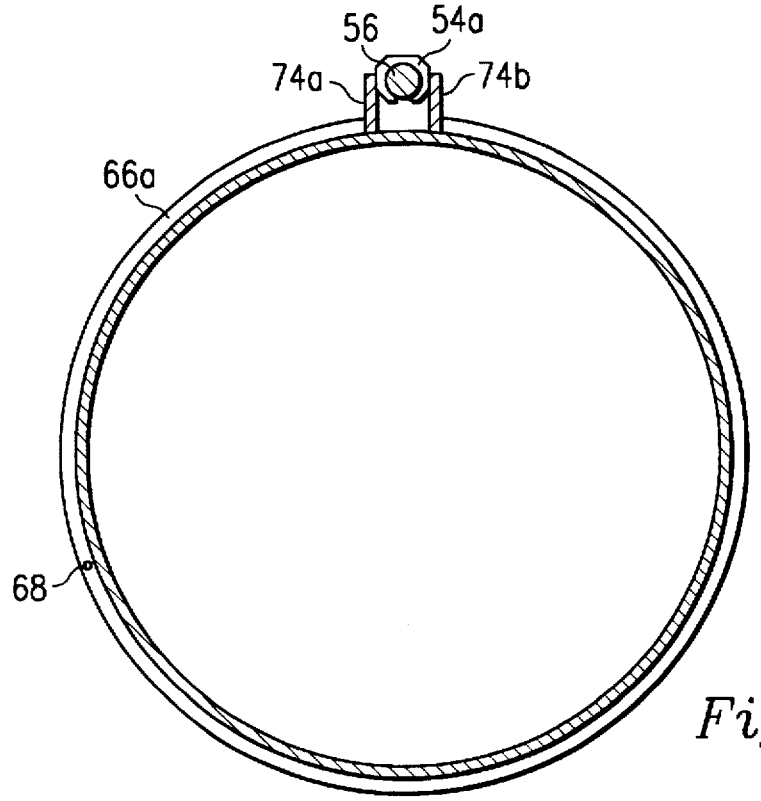
FIG. 3 is a view similar to FIG. 2 but depicting an alternate embodiment of the present invention.

The embodiment of FIG. 3 is identical to that of FIGS. 1 and 2 and identical components are given the same reference numerals. According to the embodiment of FIG. 3, the support members **54*a* and 54*b* are attached to the sleeve 50 in a different manner. More particularly, and with reference to support member 54*a* in FIG. 3, a pair of struts 74*a* and 74*b* are attached to the opposite side portions of the support member in a conventional manner, such as by welding. The lower edge portions of the struts 74*a* and 74*b* are attached to the outer surface of the sleeve 50, also in any known manner. Thus, according to the embodiment of FIG. 3, the sleeve 50 does not have to be cut away, yet will move axially in the same manner as that of the embodiment of FIGS. 1 and 2**.

It is understood that variations may be made in the foregoing without departing from the scope of the invention. For example, the support members **54*a* and 54*b*** can very and size and number. Still other changes and modifications may be made to the embodiments of the present invention without departure from the spirit and scope of the present invention as defined in the appended claims.

What is claimed is:

1. An air damper assembly comprising two spaced walls, a damper sleeve mounted for movement relative to said walls in a manner to define an air inlet with one of the walls, means for reinforcing the damper sleeve, said means being attached to an outer surface of the damper sleeve and having a guide receiving opening formed therein, a pair of spaced apart threaded support members connected to move with and suspend said damper sleeve on a threaded shaft in threaded engagement with said support members, so that rotation of said shaft causers corresponding movement of said support members and therefore said damper sleeve, to vary the size of the inlet.

2. The assembly of claim I wherein said movement of said support member, and therefore said damper, is linear.

3. The assembly of claim i wherein said two spaced walls have a circular cross section and wherein said damper sleeve extends over the outer periphery of one of said walls.

4. The assembly of claim 3 wherein said sleeve moves axially to and from the other of said walls.

5. The assembly of claim 4 wherein said sleeve is movable to a position extending between said walls to close said inlet.

6. The assembly of claim 1 wherein said support member defines an internally threaded bore for receiving said shaft.

7. The assembly of claim 6 wherein a lower portion of said support member is open.

8. An air damper assembly comprising two spaced walls, a damper sleeve mounted for movement relative to said walls in a manner to define an air inlet with one of the walls, a pair of spaced apart threaded support members connected to move with and suspend said damper sleeve on a threaded shaft in threaded engagement with said support members, so that rotation of said shaft causes corresponding movement of said support members, and therefore said damper sleeve, to vary the size of the inlet.

9. A burner assembly including an air damper comprising two spaced walls, a damper sleeve mounted for movement relative to said walls in a manner to define an air inlet with one of the walls, a pair of spaced apart threaded support members connected to move with and suspend said damper sleeve on a threaded shaft in threaded engagement with said support members so that rotation of said shaft causes corresponding movement of said support members, and therefore said damper sleeve, to vary the size of said inlet, a nozzle directing air and fuel toward an adjacent furnace opening, a pair of air flow passages concentrically surrounding the nozzle and extending from the inlet to the adjacent furnace opening and means in each of the passages being adjustable to impart a swirl to air moving through said passages to said furnace opening in a combustion supporting relationship with the air and fuel exiting from said nozzle.

* * * * *

UNITED STATES PATENT AND TRADEMARK OFFICE

CERTIFICATE OF CORRECTION

PATENT NO. : 5,738,021

DATED : April 14, 1998

INVENTOR(s) : Joel Vatsky et al.

It is certified that error appears in the above-identified patent and that said Letters Patent is hereby corrected as shown below:

Col. 1, line 26, "quantifies" should be --quantities--.

Col 1, line 48, "above-mention" should be --above-mentioned--.

Col. 1, line 50, "dogging" should be --clogging--.

Col. 3, line 24, "wall 80" should be --wall 30--.

Col. 3, line 35, "plate 82" should be --plate 32--.

Col. 3, line 36, "84b" should be --54b--.

Col. 3, line 42, "plate 80" should be --plate 30--.

Col. 5, line 2, (Claim 1), "causers" should be --causes--.

Signed and Sealed this

Eleventh Day of August 1998

Bruce Lehman

*Attest:*

BRUCE LEHMAN

*Attesting Officer*

*Commissioner of Patents and Trademarks*